US007249636B2

(12) United States Patent
Ohmer

(10) Patent No.: US 7,249,636 B2
(45) Date of Patent: Jul. 31, 2007

(54) SYSTEM AND METHOD FOR COMMUNICATING ALONG A WELLBORE

(75) Inventor: Herve Ohmer, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 284 days.

(21) Appl. No.: 10/905,012

(22) Filed: Dec. 9, 2004

(65) Prior Publication Data

US 2006/0124297 A1 Jun. 15, 2006

(51) Int. Cl.
*G01V 3/00* (2006.01)

(52) U.S. Cl. ..... 166/383; 166/65.1; 340/853.1; 340/854.3

(58) Field of Classification Search ..... 166/65.1, 166/383; 340/853.1, 854.3, 854.7, 854.9
See application file for complete search history.

(56) References Cited

U.S. PATENT DOCUMENTS

| | | | | |
|---|---|---|---|---|
| 4,057,781 | A | 11/1977 | Scherbatskoy | |
| 4,215,426 | A | 7/1980 | Klatt | |
| 4,569,392 | A * | 2/1986 | Peterman | 166/65.1 |
| 4,683,944 | A * | 8/1987 | Curlett | 166/65.1 |
| 5,160,925 | A | 11/1992 | Dailey et al. | |
| 5,235,285 | A | 8/1993 | Clark et al. | |
| 5,448,227 | A | 9/1995 | Orban et al. | |
| 5,467,832 | A | 11/1995 | Orban et al. | |
| 5,519,668 | A | 5/1996 | Montaron | |
| 5,941,307 | A | 8/1999 | Tubel | |
| 5,945,923 | A | 8/1999 | Soulier | |
| 6,057,784 | A | 5/2000 | Schaaf et al. | |
| 6,188,222 | B1 | 2/2001 | Seydoux et al. | |
| 6,192,988 | B1 | 2/2001 | Tubel | |
| 6,343,649 | B1 | 2/2002 | Beck et al. | |
| 6,464,011 | B2 | 10/2002 | Tubel | |
| 6,491,828 | B1 * | 12/2002 | Sivavec et al. | 210/739 |
| 2001/0013412 | A1 | 8/2001 | Tubel | |
| 2003/0020631 | A1 * | 1/2003 | Haase et al. | 340/853.1 |
| 2004/0108108 | A1 | 6/2004 | Bailey et al. | |

FOREIGN PATENT DOCUMENTS

| | | | |
|---|---|---|---|
| EP | 0 553 908 | B1 | 10/1996 |
| EP | 0 995 877 | B1 | 5/2003 |
| EP | 0 903 591 | B1 | 6/2003 |
| EP | 0 816 632 | B1 | 9/2003 |
| GB | 2 364 724 | A | 2/2002 |
| WO | 01/63804 | A1 | 8/2001 |

* cited by examiner

*Primary Examiner*—William Neuder
(74) *Attorney, Agent, or Firm*—Trop, Pruner + Hu, P.C.; Dona C. Edwards; Bryan P. Galloway

(57) ABSTRACT

A system and method is provided for communicating with a device disposed in a wellbore. Signals are communicated between a surface location and the device via a hardwired section of wellbore and a wireless section of wellbore. The signal is sent downhole or uphole over a portion of the distance via a communication line and over another portion of the distance via wireless communication.

31 Claims, 4 Drawing Sheets

SYSTEM AND METHOD FOR COMMUNICATING ALONG A WELLBORE

BACKGROUND

In a variety of wellbore applications, communications are sent between a surface location and a downhole location. The transmission of signals within the wellbore enables downhole data acquisition, activation and control of downhole devices, and numerous other applications. For example, command and control signals may be sent from a controller located at the surface to a wellbore device located within a wellbore. In other applications, downhole devices, such as sensors collect data and relay that data to a surface location through an "uplink" for evaluation or use in the specific well related operation. The communications can be monitored and controlled at the surface by a control system located at the well site.

Communication signals are transferred along physical control lines. For example, the signals may be sent as electronic signals along a conductive wire, or the signals may be sent as hydraulic signals along a tubular control line. Thus, physical control lines often are run along a work string extending through a given wellbore. However, the communication becomes difficult or impossible if there are gaps in the work string, or if sections of work string do not have communication lines. Additionally, control lines can be particularly susceptible to damage in certain regions of the wellbore.

SUMMARY

In general, the present invention provides a system and method of communication between a surface location and a subterranean, e.g. downhole, location. Signals are sent along the wellbore via a combination of at least one hardwired section of the wellbore and at least one wireless section of the wellbore. For example, a receiver and/or transmitter may be connected to a communication line of the hardwired section for receipt and/or transmission of signals from and/or to a device disposed in the wellbore at a location remote from the hardwired section.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to communication with subterranean equipment via transmission of communication signals through a hardwired section of wellbore and an unwired or wireless section of wellbore. Throughout this description, the use of the terms "wired" or "hardwired" refers to sections of wellbore that utilize a physical communication line, such as an electrically conductive line, an optical fiber line, a hydraulic control line or other defined, physical structure through which communication signals are transmitted. By way of example, the hardwired section of the wellbore may comprise a control line routed alone a wellbore system, such as a work string disposed within a wellbore. However, the devices and methods of the present invention are not limited to use in the specific applications that are described herein.

Figure 1:
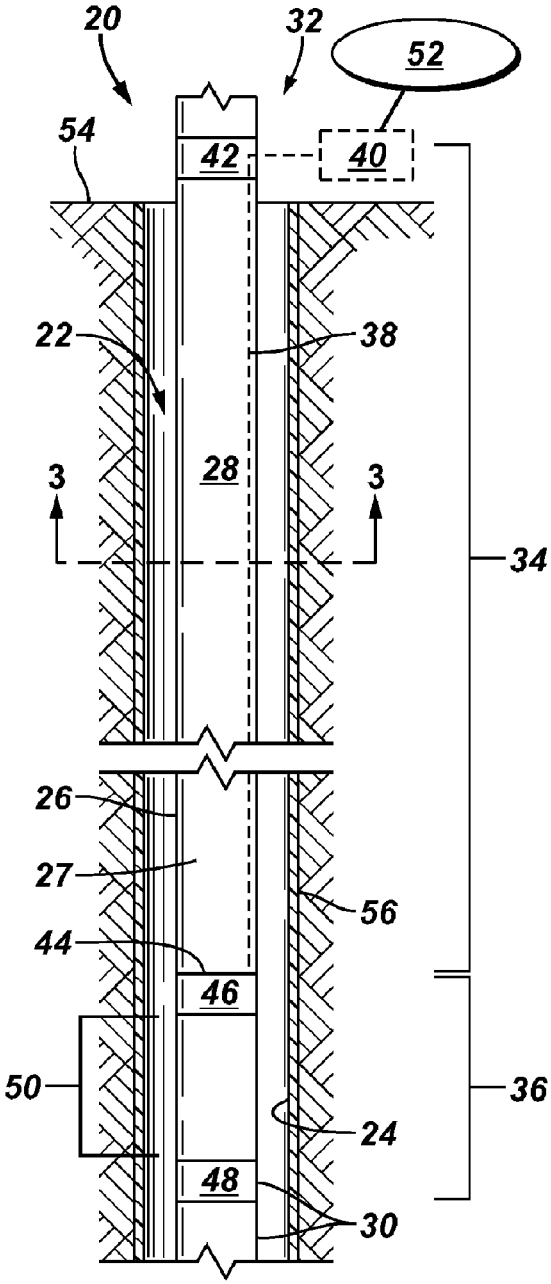
FIG. 1 is a schematic illustration of a communication system, according to an embodiment of the present invention.

Referring generally to FIG. 1, a system 20 is illustrated according to an embodiment of the present invention. In this embodiment, system 20 comprises a wellbore system 22 deployed in a wellbore 24. Wellbore system 22 may comprise a work string 26, and work string 26 may be formed of a variety of components utilized in downhole applications. For example, work string 26 may comprise a completion 27 having a tubing section 28 as well as a variety of other wellbore components 30. The specific type of wellbore components 30 depend on the wellbore application, but the components can be selected from, for example, sensors, testing equipment, servicing equipment, production equipment and other types of devices.

System 20 generally comprises a telemetry system 32 for communicating data between a surface location and a downhole location. For example, signals may be communicated downhole to a wellbore device, such as one or more of the wellbore components 30. In some embodiments, signals also can be communicated from the downhole device or devices 30, located in the wellbore, to a surface location through an uplink. Embodiments of the telemetry system 32 also may be designed for two-way communication between the surface location and the wellbore location or locations.

Telemetry system 32 creates a "hardwired" section 34 within wellbore 24 and an "unwired," e.g. wireless, section 36 within wellbore 24. Thus, data is communicated through wellbore 24 via a combination of one or more hardwired sections 34 with one or more wireless sections 36 of wellbore 24. In the embodiment illustrated, hardwired section 34 comprises a communication line 38 that extends along an upper section of work string 26. Communication line 38 extends between a surface communication device 40, via an appropriate work string interface 42, and a terminal end 44 disposed at the lower end of the upper section of work string 26. The particular style of surface communication device 40 and work string interface 42 depends on the specific type of communication line 38 that is utilized in a given application. For example, communication line 38 may comprise a control line or a line for communicating data from downhole sensors. Communication line 38 also may have different structural forms including an electrical conductor, such as an electrical wire or wire bundle, for carrying electric signals. Communication line 38 also may comprise an optical fiber, hydraulic control line or other structural control line through which signals are sent.

Telemetry system 32 further comprises wireless section 36 having, for example, an upper communication device 46 coupled to terminal end 44 and a lower communication device 48. Upper communication device 46 and lower communication device 48 are separated by a separation distance 50 over which the signals travel wirelessly along wellbore 24. Hardwired section 34 and wireless section 36 each may comprise multiple sections over which the subject signals are transmitted. Additionally, the specific type of upper communication device 46 and lower communication device 48 depends on the technique selected for wireless communication. Two examples, however, of wireless communication systems comprise an electro-magnetic communication system and an acoustic communication system.

Generally, an electromagnetic communication (EM) system utilizes electromagnetic waves for carrying signals between communication devices 46 and 48. For example, communication devices 46 and 48 may comprise low-frequency radiowave equipment or traditional pulse telemetry equipment. An acoustic communication system generally utilizes sound waves to carry signals between the wireless communication devices. For example, communication devices 46 and 48 may comprise transducers able to convert signals to and from acoustic waves propagated through a fluid in the wellbore.

In many applications, the flow of signals through telemetry system 32 is controlled by an operational control 52. Operational control 52 may comprise a variety of control systems, including processor-based control systems. For example, an operator may utilize a computer having an appropriate input device, such as a keyboard, touchscreen, audio input device or other input device, for providing instructions to operational control 52 as to the types of signals, e.g. command and control signals, sent via telemetry system 32. The computer-based control also may utilize an output device, such as a display screen or other output device, to convey relevant information to the operator regarding the telemetry system 32 and/or signals sent via the communication system. Operational control 52 also may comprise a device located at a surface 54 of the earth proximate wellbore 24 or at a remote location.

In the embodiment illustrated in FIG. 1, wellbore system 22 is contiguous through both hardwired section 34 and wireless section 36. In this example, wellbore system 22 comprises work string 26 which extends from a surface location to, for example, lower communication device 48. Work string 26 may comprise a variety of wellbore components depending on the particular wellbore application, including tubing sections, upper completions, lower completions, production equipment, testing equipment, drilling equipment, sensing equipment, injection equipment and other well related equipment. Additionally, the wellbore system 22 may be deployed in a wellbore 24 having a surrounding wellbore casing 56 or in an open bore wellbore.

Figure 2:
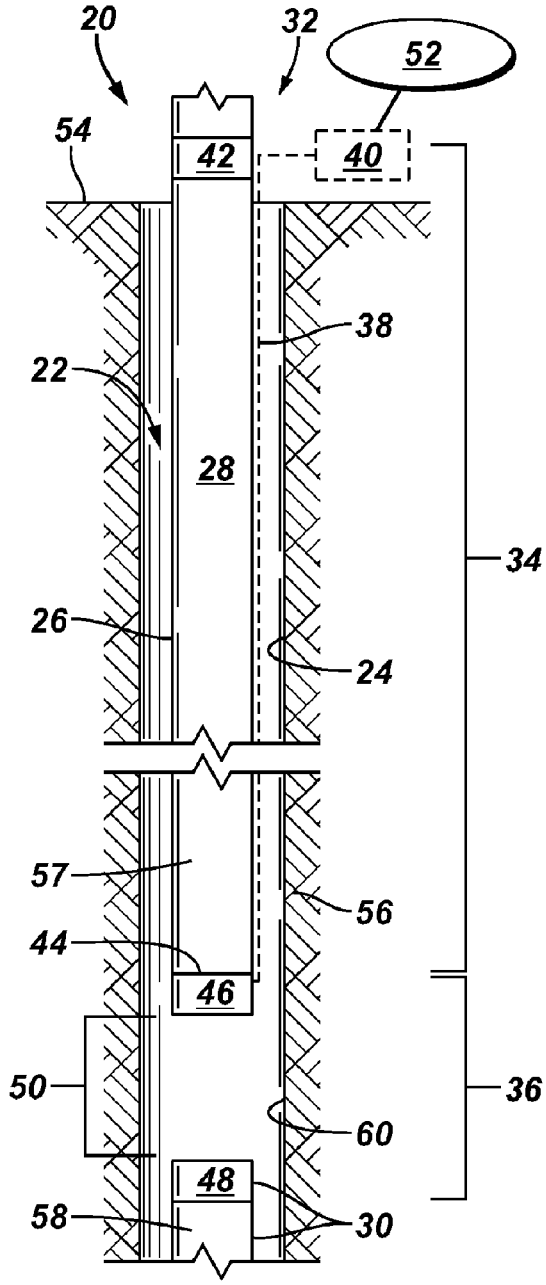
FIG. 2 is a schematic illustration of another embodiment of the communication system illustrated in FIG. 1.

In another embodiment illustrated in FIG. 2, wellbore system 22 is not contiguous and there is a gap creating a separation distance 50 between an upper completion 57 and a lower completion 58, e.g. a gravel pack. In this embodiment, wireless section 36 of communication system 32 can be utilized to communicate signals through the wellbore even when no physical work string or other physical element is positioned within a section of the wellbore. In the example illustrated, separation distance 50 covers an open hole region 60 of wellbore 24 that does not contain any connecting portion of work string 26.

Figure 3:
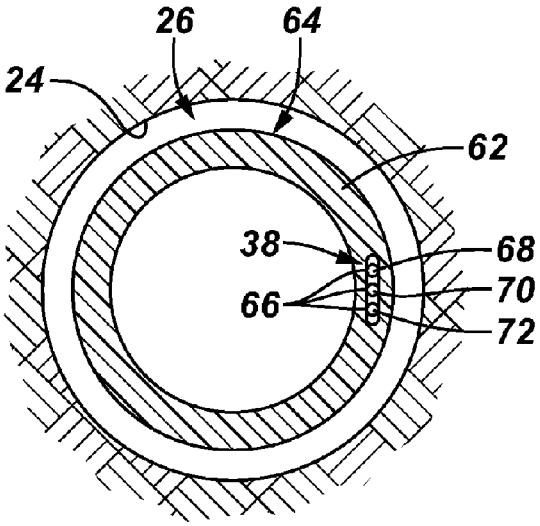
FIG. 3 is a cross-sectional view taken generally along line 3-3 illustrated in FIG. 1.

Hardwired section 34 of telemetry system 32 can be adapted to operate in a variety of wellbore environments with specific communication lines routed along the work string 26. Referring generally to FIG. 3, communication line 38 may be embedded in a wall 62 of a tubular 64, such as a well pipe or other tubular component/completion utilized in a wellbore. Communication line 38 comprises one or more individual communication lines 66, and the communication lines 66 can take more than one structural form, e.g. a mixture of electrical 68, optical 70 and hydraulic 72 control lines. By way of example, however, communication line 38 comprises at least one electrical conductor 68 embedded in the wall 62. The electrical conductor 68 can extend longitudinally through wall 62 of the entire tubular 64, or inductive couplings can be formed across connection regions to facilitate transmission of signals through tubular connections.

Figure 4:
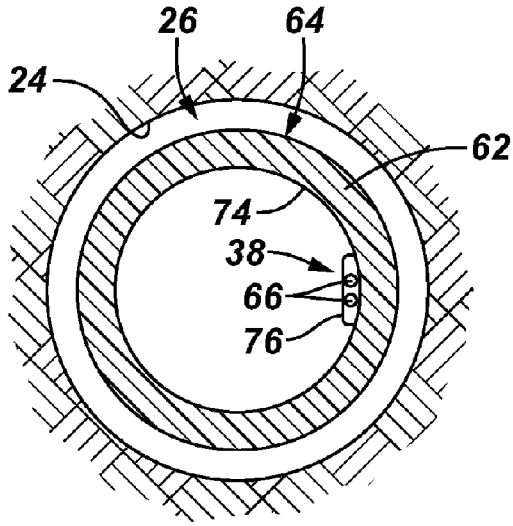
FIG. 4 is another cross-sectional view showing an alternate embodiment of the work string illustrated in FIG. 3.
Figure 5:
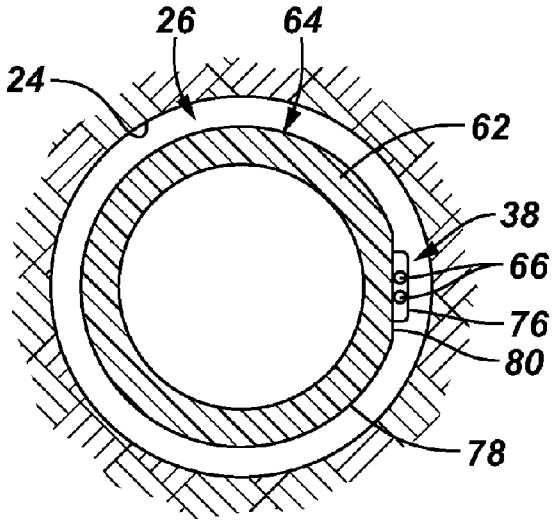
FIG. 5 is a cross-sectional view showing another alternate embodiment of the work string illustrated in FIG. 3.

Alternate arrangements of communication line 38 also can be utilized in a given application, as illustrated in FIGS. 4 and 5. In FIG. 4, communication line 38 is run generally longitudinally along an interior surface 74 of wall 62. One or more individual communication lines 66 may be covered by or encapsulated in a protective jacket 76. In FIG. 5, communication line 38 is deployed along an exterior surface 78 of tubular wall 62. Again, one or more individual communication lines 66 may be covered by or encapsulated in the protective jacket 76. Additionally, tubular 64 may comprise a flat or recessed portion 80 for receiving communication line 38. Portion 80 receives communication line 38 in a manner that protects communication line 38 and conserves wellbore space. Accordingly, recessed portion 80 also can be formed in interior surface 74 for interior communication lines.

Figure 6:
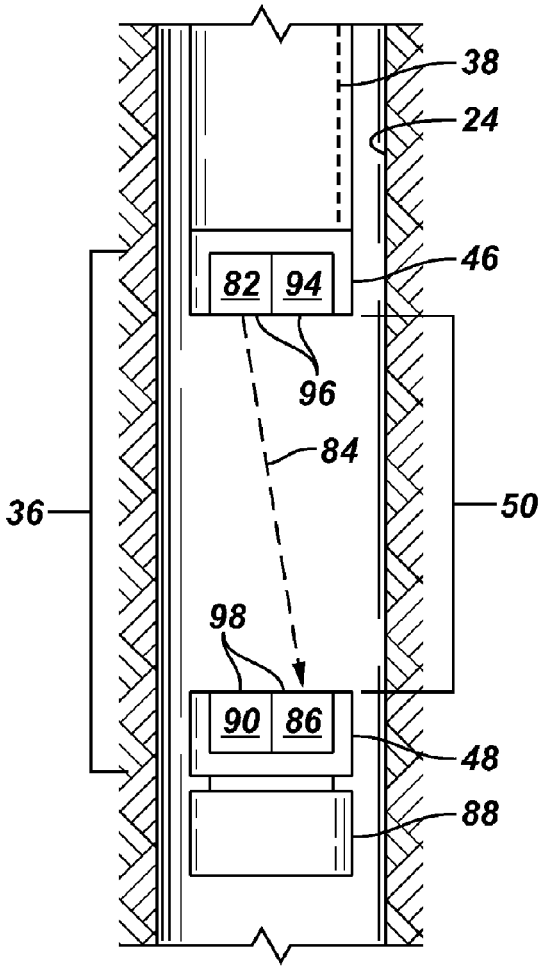
FIG. 6 is a schematic illustration of a wireless communication system deployed in a wellbore, according to an embodiment of the present invention.

Wireless section 36 is a portion of telemetry system 32 able to communicate signals over a region or regions of wellbore 24 wirelessly. Depending on the specific wellbore application, communication devices 46 and 48 may comprise a variety of transmitters and receivers. As illustrated in FIG. 6, upper communication device 46 may comprise a transmitter 82 for relaying the signals received from communication line 38 to a corresponding receiver 86 via a wireless signal 84. Receiver 86 is disposed, for example, in lower communication device 48. The content of wireless signal 84 will vary depending on the wellbore application, but one example is a command and control signal for controlling a downhole tool 88, such as a valve, steerable drilling assembly, or a variety of other wellbore tools.

Figure 7:
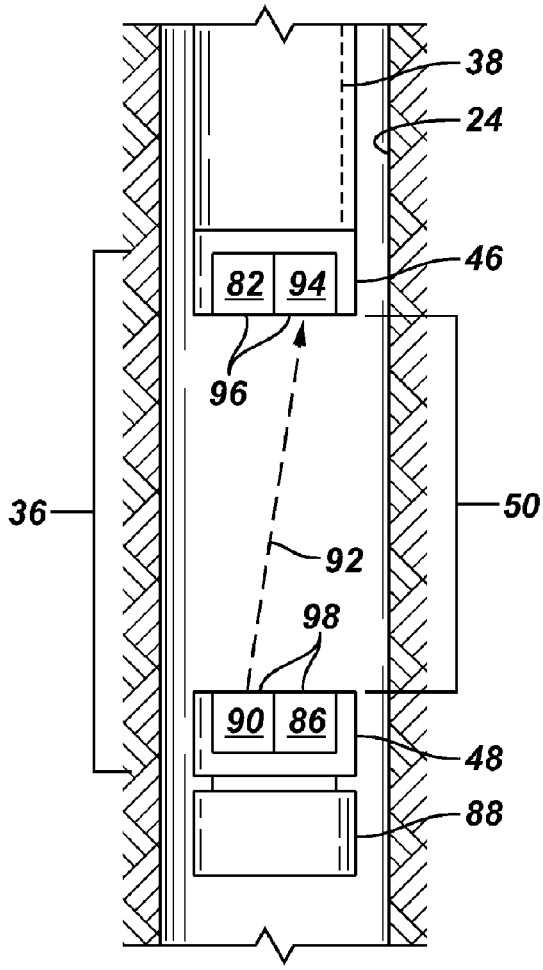
FIG. 7 is another schematic illustration of a communication system deployed in a wellbore, according to an embodiment of the present invention.

Alternatively or in addition, lower communication device 48 may comprise a transmitter 90 for sending an uplink wireless signal 92 to a corresponding receiver 94 of upper communication device 46, as illustrated in FIG. 7. This signal, in turn, can be relayed, via communication line 38, to a surface location, e.g. to surface communication device 40. The uplink signal content will vary depending on the specific wellbore application. For example, uplink wireless signal 92 may comprise data from downhole device 88, such as sensor data, and/or the uplink signal 92 can carry an acknowledgment of receipt of a command and control signal. Thus, depending on the wellbore application, the telemetry system 32 can be used for downlink signals, e.g. signals 84, for uplink signals, e.g. signals 92, or multiple transmitters and receivers can be used for two-way communication via an upper transceiver 96 and a lower transceiver 98. Of course, if there are additional wireless sections 36, additional transmitters and/or receivers are appropriately deployed along wellbore 24. Additionally, the technique and protocol for sending wireless signals can utilize electromagnetic waves, acoustic waves or other suitable techniques for wireless communication in a subterranean environment.

Examples of methods of operation of system 20 can be explained with reference to the flowcharts of FIGS. 8 and 9. It should be noted, however, that these are examples to facilitate an understanding of the system, and the reader should realize the operational methodology is adjusted according to the specific wellbore application. For example, some applications may require only a downlink communication, other applications may require only an uplink communication, and still other applications may benefit from two-way communication via telemetry system 32.

Figure 8:
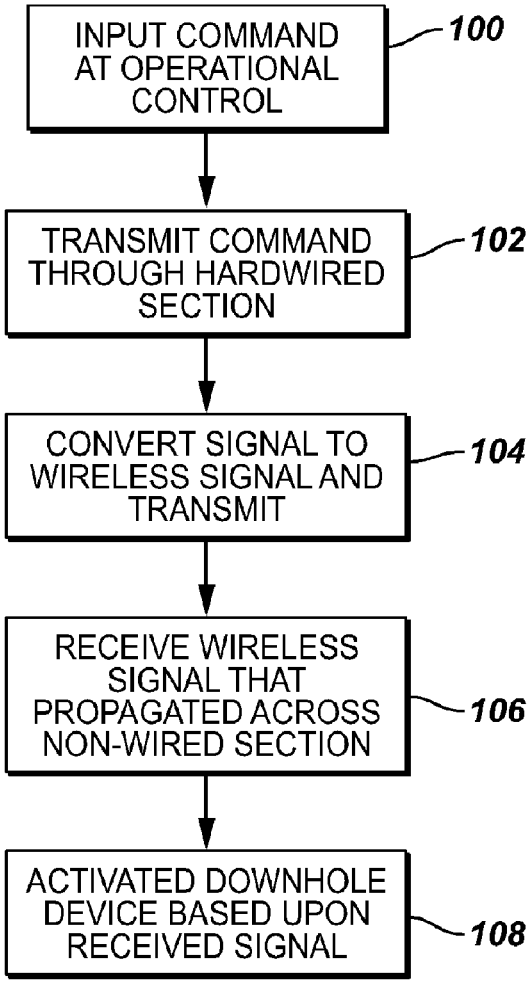
FIG. 8 is a flowchart illustrating one example of an operational technique for use of the communication system, according to an embodiment of the present invention.

With reference to FIG. 8, the method example comprises initially inputting a command at operation control 52, as illustrated by block 100. A command signal is then transmitted through hardwired section 34 via surface communication device 40 and work string interface 42, as illustrated by block 102. Surface communication device 40 and work string interface 42 are designed to transmit the specific type of signal carried by communication line 38, e.g. electrical signal, optical signal, hydraulic signal or other signal appropriate for hardwired communication line 38. A variety of equipment can be used for the transmission of, for example, the electrical, optical or hydraulic signals, as known to those ordinary skill in the art.

Subsequently, the signal carried by communication line 38 is converted to a wireless signal and transmitted via upper communication device 46, as illustrated by block 104. The wireless signal is propagated across the non-wired section 36, e.g. across separation distance 50, and received at a downhole device 30, as illustrated by block 106. The downhole device may be lower communication device 48 or a combination of the lower communication device and a wellbore tool or system coupled to device 48. The downhole device is then activated based on the received signal, as illustrated by block 108.

Figure 9:
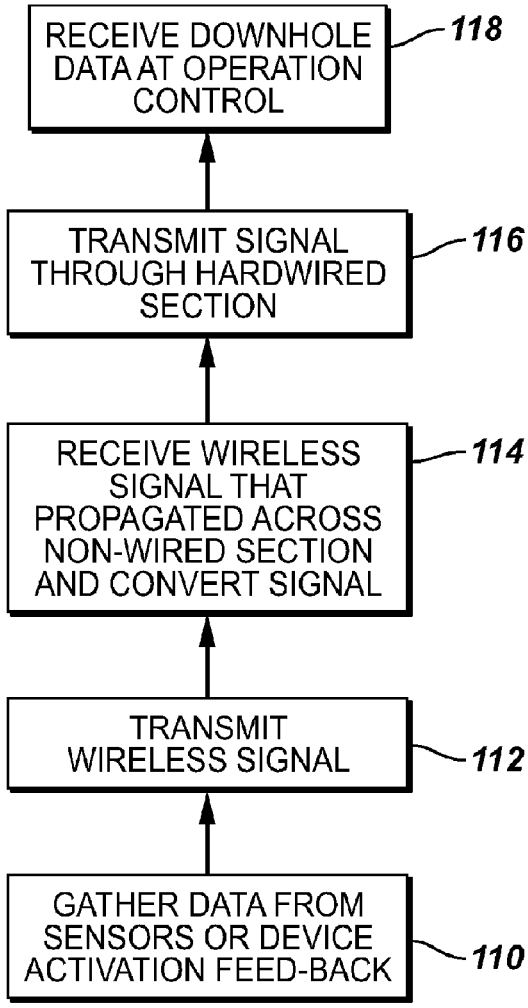
FIG. 9 is a flowchart illustrating another example of an operational technique for use of the communication system, according to an embodiment of the present invention.

System 20 also can utilize telemetry system 32 to provide uplink communication from downhole device 30 to an uphole location, such as a surface location, as illustrated in FIG. 9. For example, an uplink signal can be sent from one or more downhole devices 30, as illustrated by block 110. The uplink signal may comprise communication data related to a variety of downhole activities, depending on the specific wellbore application. For example, the data may comprise feedback from a downhole device after receiving a command signal, e.g. confirmation of activation of a downhole device, as illustrated by block 108 of FIG. 8. In another example, the uplink signal may comprise data gathered from a downhole sensor or sensors. Regardless, the signal is transmitted wirelessly via lower communication device 48 across wireless section 36, as illustrated by block 112.

After the wireless signal is propagated across the non-wired section 36, e.g. across separation distance 50, the wireless signal is received by upper communication device 46 and converted to an appropriate signal that can be transmitted through hardwired section 34, as illustrated by block 114. The signal is then transmitted through hardwired section 34, as illustrated by block 116. The uplink signal and contained communication data are received at an appropriate control, such as operation control 52, as illustrated by block 118. The data can then be automatically evaluated and applied by operation control 52, and/or the data can be provided to an operator through an appropriate output device for evaluation and potential action.

The sequences described with reference to FIGS. 8 and 9 provide examples of the use of system 20 in communicating with a subterranean device. However, the type of communication line 38, workstation interface equipment, surface communication device equipment, wireless communication system, number and type of completions in wellbore 24, wellbore environment and other well related parameters can affect the actual communication sequence utilized.

Accordingly, although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A communication system for use in a wellbore, comprising:

a work string having a hardwired section, for transmitting communication signals, and a wireless section;

a downhole device disposed at an end of the wireless section opposite the hardwired section; and a wireless communication system to communicate signals between the hardwired section and the downhole device.

2. The system as recited in claim 1, wherein the work string comprises a tubular.

3. The system as recited in claim 2, wherein the hardwired section comprises a communication line deployed within a wall of the tubular.

4. The system as recited in claim 2, wherein the hardwired section comprises a communication line deployed adjacent a wall of the tubular.

5. The system as recited in claim 1, wherein the device comprises a receiver.

6. The system as recited in claim 1, wherein the device comprises a transmitter.

7. The system as recited in claim 5, wherein the wireless communication system comprises a transmitter operatively coupled to the hardwired section.

8. The system as recited in claim 6, wherein the wireless communication system comprises a receiver operatively coupled to the hardwired section.

9. The system as recited in claim 1, wherein the hardwired section comprises an optical fiber to carry desired signals.

10. The system as recited in claim 1, wherein the wireless communication system comprises an electromagnetic communication system.

11. The system as recited in claim 1, wherein the wireless communication system comprises an acoustic communication system.

12. A method for transmitting signals along a wellbore, comprising:

transmitting data along a first portion of a wellbore through a communication line; and wirelessly transmitting the data along a second portion of the wellbore to a downhole device disposed in the wellbore.

13. The method as recited in claim 12, wherein transmitting comprises transmitting the data along a communication line deployed along a work string.

14. The method as recited in claim 13, wherein wirelessly transmitting comprises transmitting the data across a gap in the work string.

15. The method as recited in claim 12, wherein transmitting comprises transmitting the data along a communication line disposed within a wall of a tubing extending along at least the first portion of the wellbore.

16. The method as recited in claim 12, wherein transmitting comprises transmitting the data along a communication line in the form of an electrical conductor extending along at least the first portion of the wellbore.

17. The method as recited in claim 12, wherein transmitting comprises transmitting the data along a communication line in the form of an optical fiber extending along at least the first portion of the wellbore.

18. The method as recited in claim 12, wherein wirelessly transmitting comprises transmitting data from a terminal end of the communication line to the downhole device.

19. The method as recited in claim 12, further comprising:

transmitting data from the downhole device to a receiver connected to the communication line.

20. The method as recited in claim 12, wherein wirelessly transmitting comprises transmitting signals acoustically.

21. The method as recited in claim 12, wherein wirelessly transmitting comprises transmitting signals via an electromagnetic communication system.

22. The method as recited in claim 12, wherein wirelessly transmitting comprises transmitting signals along an open borehole.

23. The method as recited in claim 12, wherein wirelessly transmitting comprises transmitting signals along an unwired section of a work string.

24. A method of transmitting data downhole, comprising:

sending a signal downhole along a section of tubing having a communication line for carrying the signal, the tubing being located in a wellbore;

receiving the signal at a downhole transceiver; and transmitting the signal wirelessly to a receiver deployed further downhole in the wellbore.

25. The method as recited in claim 24, wherein sending comprises sending the signal from a transmitter disposed at a surface of the earth.

26. The system as recited in claim 24, wherein sending comprises sending the signal downhole along the section of tubing disposed in a work string; and transmitting comprises transmitting the signal wirelessly across a gap in the work string.

27. The method as recited in claim 24, further comprising deploying the communication line within a wall of the tubing.

28. The method as recited in claim 24, further comprising deploying the communication line along an exterior of a wall of the tubing.

29. The method as recited in claim 24, further comprising deploying the communication line along an interior of a wall of the tubing.

30. The method as recited in claim 24, further comprising transmitting an uplink signal from the receiver to the downhole transceiver.

31. The method as recited in claim 24, wherein transmitting comprises transmitting the signal over an open borehole section.

* * * * *